United States Patent [19]

Mumford

[11] 4,076,152

[45] Feb. 28, 1978

[54] FITMENT-RETAINING CLOSURE

[75] Inventor: George V. Mumford, Toledo, Ohio

[73] Assignee: Owens-Illinois, Inc., Toledo, Ohio

[21] Appl. No.: 799,847

[22] Filed: May 23, 1977

[51] Int. Cl.[2] ..... B65D 47/00

[52] U.S. Cl. ..... 222/545; 215/321; 215/350

[58] Field of Search ..... 222/545, 565; 215/277, 215/321, 350

[56] References Cited

U.S. PATENT DOCUMENTS

| | | | |
|---|---|---|---|
| 2,547,590 | 4/1951 | McGinnis | 222/545 X |
| 3,276,642 | 10/1966 | Johnson | 222/565 X |
| 3,715,063 | 2/1973 | Susuki | 222/545 |

*Primary Examiner*—Donald F. Norton
*Attorney, Agent, or Firm*—A. J. Steger; E. J. Holler

[57] ABSTRACT

A fitment-retaining closure adapted to facilitate simultaneous application of the closure and fitment to a container and allow the fitment to remain on the container upon removal of the closure. The closure includes a plurality of fitment-retaining, flexible projections extending downwardly from its top panel for grasping and retaining the fitment. Once the preassembled closure and fitment have been applied to a container, the closure may be removed without disturbing the fitment as the interference fit of the fitment to the container is greater than the frictional fit between the flexible projections on the closure and the fitment.

7 Claims, 3 Drawing Figures

FITMENT-RETAINING CLOSURE

BACKGROUND OF THE INVENTION

This invention relates to closures for containers and, more particularly, it relates to closure and fitment combinations which are utilized with containers.

The packaging of many products requires the use of a special fitment for dispensing the product from the container. Examples of such fitments include pourout fitments for liquid products and sifter fitments for powder or granular products. Such packaging usually includes a fitment which is snapped into engagement with the neck portion of the container, and a separate outer cap or closure which is then threaded into engagement with the container. Until now, the assembly of such packages required separate steps for placing the fitment onto the container, followed by engaging the closure to the container. In addition, such commercially available closures and fitments had to be shipped and stored separately from one another prior to application to a container. Thus, the use of a special fitment greatly increases the handling and assembly cost of the package.

SUMMARY OF THE INVENTION

It is, therefore, an object of the invention to provide a unique, improved combination closure and fitment, wherein the closure incorporates fitment retention means, so that the fitment and closure may be preassembled.

The closure of this invention includes a plurality of fitment-retaining, flexible projections extended downwardly from its top panel for grasping and retaining the fitment in a preassembled condition. This eliminates the need for separate shipping and handling facilities for the closure and fitment. This also facilitates the simultaneous application of the preassembled closure and fitment to a container. As the unique preassembled closure and fitment of the subject invention is applied to a container, the fitment is simultaneously snapped into engagement with the container.

Once the preassembled closure and fitment have been applied to a container, the closure may be removed without disturbing the fitment as the interference fit of the fitment to the container is greater than the grasping force between the flexible projections on the closure and the fitment.

Other objects, features and advantages of this invention will become apparent upon reference to the following detailed description of the invention and the drawings illustrating a preferred embodiment thereof.

IN THE DRAWINGS

DETAILED DESCRIPTION OF A PREFERRED EMBODIMENT

Figure 1:
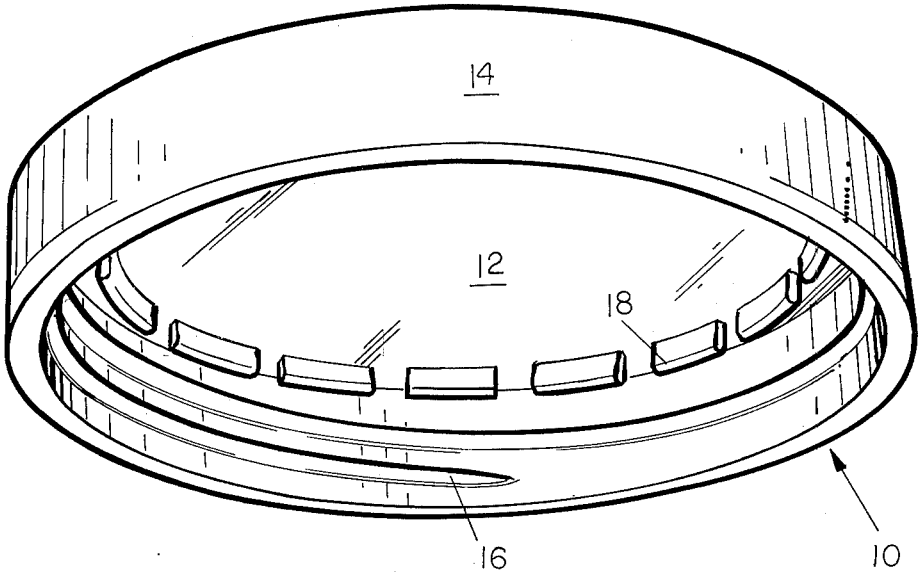
FIG. 1 is a perspective view of the unique fitment-retaining closure of this invention.

Referring now to the drawings, FIG. 1 illustrates the improved fitment-retaining closure of the subject invention, which is indicated generally by the numeral 10. The closure 10, which preferably may be formed from polypropylene, includes a top panel 12 and a depending skirt 14, which extends downwardly from the outer periphery of the top panel 12. The interior surface of skirt 14 includes a threaded portion 16. Extended downwardly from the interior surface of the top panel 12 are a plurality of flexible fitment-retaining projections 18, which are spaced around the circumference of the top panel 12. The fitment-retaining projections 18 are spaced inwardly from the skirt 14 and have a rounded or arcuate interior surface 20.

Figure 2:
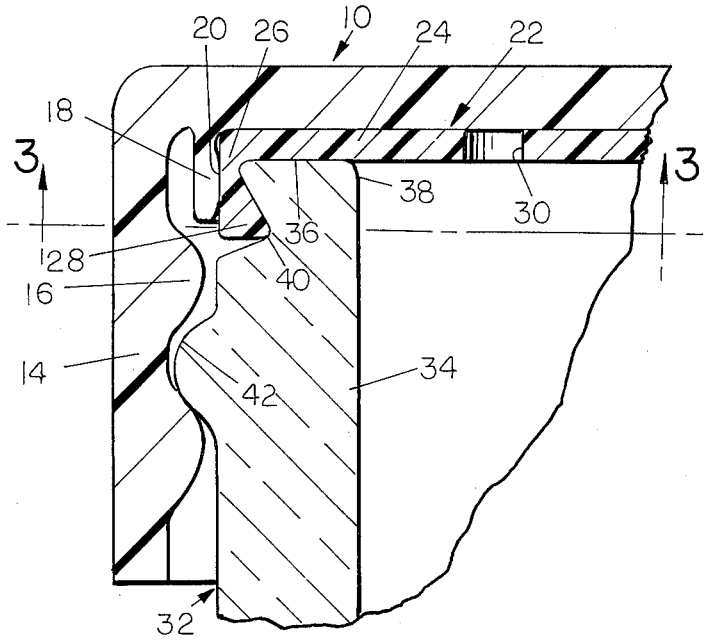
FIG. 2 is a partial, sectional view of the fitment-retaining closure and fitment of this invention, as they are applied to a container.
Figure 3:
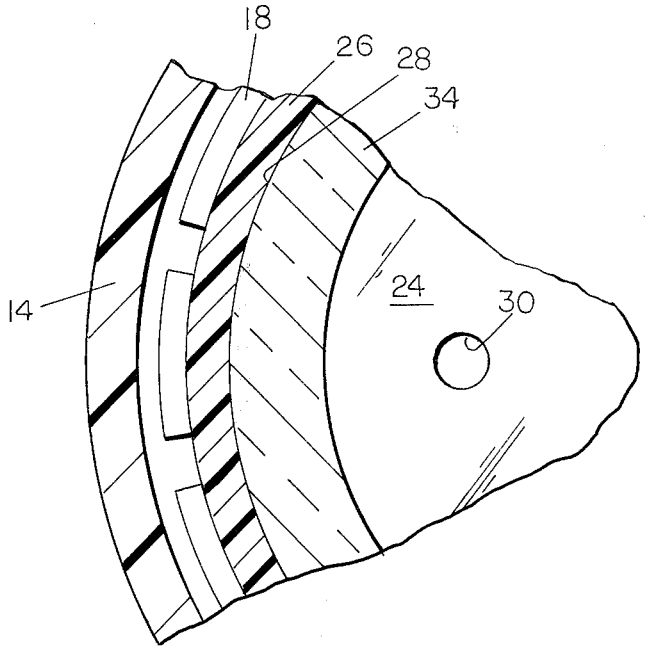
FIG. 3 is a partial, sectional view taken in the direction of arrows A—A in FIG. 2.

The fitment can best be seen by reference to FIG. 2, where it is indicated generally by the numeral 22. The fitment 22 may be of any type which is suitable to interact with the product being contained. For the purposes of illustration of this invention, a sifter-type fitment has been chosen. The fitment 22, which preferably may be formed from polyethylene, includes a top panel 24 and a depending skirt 26 which extends downwardly from the outer periphery of the top panel 24. The skirt 28 incorporates an inwardly directed retaining bead 28 at its lower extremity. A plurality of apertures 30 are formed in the top panel 24 to provide means by which product may be sifted or dispensed from the package.

The container, indicated generally by the numeral 32 in FIG. 2, may be of any suitable type which includes a neck portion 34 terminating at its upper end in an annular rim 36, which defines the periphery of an open mouth 38. The neck 34 includes a fitment-retaining groove 40 formed in its outer surface adjacent to the annular rim 36. The neck portion 34 also includes a threaded region 42 spaced downwardly from the fitment-retaining recess 40.

The fitment 22 may be preassembled into the fitment-retaining closure 10 such that the fitment-retaining projections 18 grasp the fitment 22 around its skirt portion 26. The flexible projections 18 incorporate an arcuate interior surface 20 for engagement with the skirt portion 26 of the fitment 22. When it is desired to attach the preassembled closure and fitment to the container 32, the closure 10 is threaded onto the container by means of its threads 16 which matingly engage with the threads 42 on the container neck 34. As the closure 10 is being threaded into engagement with the container 32, the fitment 22, which is retained within the closure 10 by means of the fitment-retaining projections 18, is snapped over the upper rim 36 of the container neck 34, so that the inwardly directed retaining bead 28 on the fitment 22 is firmly engaged in retaining recess 40 in the container neck 34. As can be seen in FIG. 2, the interference fit between the bead 28 on the fitment 22 and the annular groove 40 on the container 32 is substantially greater than the frictional-type grasping fit between the projections 18 on the closure 10 and the outer surface of the fitment skirt 26. Thus, when the closure 10 is rotated out of threaded engagement with the container 32, the projections 18 will slide out of engagement with the fitment 22, thereby leaving the fitment 22 in its assembled position on the container 32.

Thus, through the utilization of the unique fitment-retaining closure of this invention, a fitment and closure may be preassembled to eliminate the shipping and handling problems associated with having two separate items. In addition, the combination closure and fitment may be assembled to a container in one step, thereby eliminating the necessity for separate steps for assembling the fitment and closure individually to a container neck.

Furthermore, the unique closure and fitment of this invention are designed so that the closure may be continually removed from and reapplied to the container without disturbing the engagement of the fitment and the container.

What I claim is:

1. A fitment-retaining closure and fitment combination which is adapted for use with a container with a neck portion terminating in an annular rim defining an open mouth and having a fitment-retaining groove formed near its upper extremity and threads formed therebelow, said closure and fitment combination comprising:

a fitment member having a fitment top panel spanning the open mouth of said container and a fitment skirt depending from the outer periphery of the fitment top panel, the fitment skirt including an annular retaining bead extending inwardly from the lower end thereof and adapted to engage the fitment-retaining groove in the container neck portion; and a fitment-retainer closure including a closure top panel and a closure skirt depending from the outer periphery of said closure top panel, said closure skirt having threads formed on its interior surface which are adapted to matingly engage with said threads on the container neck to enable said closure to be placed in threaded engagement with said container, said closure top panel having a plurality of fitment-retaining, flexible projections extending downwardly therefrom and spaced about the circumference thereof to engage and retain said fitment member for simultaneous application of said closure and said fitment to said container.

2. A fitment-retaining closure and fitment combination as set forth in claim 1, wherein said fitment-retaining, flexible projections have an arcuate inner surface.

3. A fitment-retaining closure and fitment combination, as set forth in claim 1, wherein said fitment top panel has a plurality of apertures formed therein for dispensing product from said container.

4. A fitment-retaining closure and container combination comprising:

a container including a neck portion terminating in an annular rim defining an open mouth, said neck portion having a fitment-retaining groove formed near said annular rim and a plurality of threads formed therebelow;

a fitment member having a fitment top panel spanning the open mouth of said container and a fitment skirt depending from the outer periphery of the fitment top panel, the fitment skirt including an annular retaining bead extending inwardly from the lower end thereof and adapted to engage the fitment-retaining groove in the container neck portion; and a fitment-retaining closure, including a closure top panel and a closure skirt depending from the outer periphery of said closure top panel, said closure skirt having threads formed on its interior surface which are adapted to matingly engage with said threads on the container neck to enable said closure to be placed in threaded engagement with said container, said closure top panel having a plurality of fitment-retaining, flexible projections extending downwardly therefrom and spaced about the circumference thereof to engage and retain said fitment member for simultaneous application of said closure and said fitment to said container.

5. A fitment-retaining closure and container combination, as set forth in claim 4, wherein said fitment-retaining, flexible projections have an arcuate inner surface.

6. A fitment-retaining closure and container combination, as set forth in claim 4, wherein said fitment top panel has a plurality of apertures formed therein for dispensing product from said container.

7. A fitment-retaining closure and fitment combination which is adapted for use with a neck portion terminating in an annular rim defining an open mouth and having threads formed on its exterior surface, said closure and fitment combination comprising:

a fitment member having a fitment top panel spanning the open mouth of said container and a fitment skirt depending from the outer periphery of the fitment top panel, the fitment skirt including interference fit means adapted to engage the container neck portion; and a fitment-retaining closure including a closure top panel and a closure skirt depending from the outer periphery of said closure top panel, said closure skirt having threads formed on its interior surface which are adapted to matingly engage with said threads on the container neck to enable said closure to be placed in threaded engagement with said container, said closure top panel having a plurality of fitment-retaining, flexible projections extending downwardly therefrom and spaced about the circumference thereof to engage and retain said fitment member for simultaneous application of said closure and said fitment to said container.

* * * * *